United States Patent [19]

Gupta

[11] Patent Number: 4,729,717

[45] Date of Patent: Mar. 8, 1988

[54] POWER TRANSMISSION

[75] Inventor: Umesh Gupta, Clinton, Miss.

[73] Assignee: Vickers, Incorporated, Troy, Mich.

[21] Appl. No.: 946,322

[22] Filed: Dec. 24, 1986

[51] Int. Cl.[4] ..... F04B 41/06; F04B 25/04

[52] U.S. Cl. ..... 417/5; 417/216; 417/271; 417/356; 417/410; 417/426

[58] Field of Search ..... 417/1, 5, 216, 350, 417/356, 271, 410, 426, 429

[56] References Cited

U.S. PATENT DOCUMENTS

| | | | |
|---|---|---|---|
| 1,019,521 | 3/1912 | Pratt | 417/271 |
| 2,373,723 | 4/1945 | Wahlmark | 417/271 |
| 3,183,845 | 5/1965 | Tyler | 91/506 X |
| 3,295,457 | 1/1967 | Oram | 417/271 X |
| 3,306,209 | 2/1967 | Tyler | 91/472 X |
| 3,627,451 | 12/1971 | Kouns | 417/271 |

*Primary Examiner*—Carlton R. Croyle
*Assistant Examiner*—T. Olds
*Attorney, Agent, or Firm*—Barnes, Kisselle, Raisch, Choate, Whittemore & Hulbert

[57] ABSTRACT

An electric motor driven inline hydraulic apparatus comprises a common housing, a stationary shaft mounted in said housing and spaced pump cylinder block subassemblies that rotate around and are mounted on said shaft. Each subassembly includes a cylinder block and a plurality of circumferentially spaced pistons. The cylinder block subassemblies are positioned such that the pistons of one subassembly extend toward the other subassembly. A common yoke plate is mounted between the two cylinder blocks and bears the two groups of piston shoes, one on each of its two bearing surfaces. Each cylinder block is driven independent of and in direction opposite to the other by an electric motor integrally mounted such that its hollow rotor houses the block and drives it. All components described above are contained in one housing and operate submerged in hydraulic fluid.

8 Claims, 12 Drawing Figures

POWER TRANSMISSION

This invention relates to power transmissions and particularly to electric motor driven hydraulic pumps.

BACKGROUND AND SUMMARY OF THE INVENTION

In hydraulic pumps which are driven by an electric motor, it has been common to provide an electric motor in one housing and the hydraulic pump in another housing with the two housings positioned in line so that the motor and pump have their own sets of bearings and shafts that are usually coupled through internal and external splines. Such an arrangement is axially long and necessitates the use of relatively expensive machined shafts and associated bearings. It has been suggested that the two housings utilize a common shaft but this makes the construction even more expensive since the shaft must be accurately formed. A typical such arrangement is shown in U.S. Pat. No. 3,672,793.

Among the objectives of the present invention are to provide an arrangement wherein the electric motor and pump are embodied in the same housing and coupled directly without a rotating shaft; which utilizes a simple stationary shaft that is readily made and yet maintains an accurate support for the rotating pump components; which is relatively simple, axially compact and rugged in construction; which is less costly to manufacture; which reduces the audible noise; which results in equal and opposite radial and axial forces on the yoke plate thereby reducing its stresses and the force on the supporting pintle bearings to a neglibile value; which results in smaller yoke spring and yoke control piston; which eliminates dynamic seals; which readily achieves a constant power operation without the aid of a compensator valve for this region; which automatically destrokes the yoke during starting should the pressure rise faster than the motor speed; which efficiently dissipates heat from the electric motor permitting the use of smaller and lighter motors capable of large overloads for short duration.

In accordance with the invention, an electric motor driven inline hydraulic pump comprises a common housing, a stationary shaft mounted in said housing and spaced pump cylinder block subassemblies that rotate around and are mounted on said shaft. Each subassembly includes a cylinder block and a plurality of circumferentially spaced pistons. The cylinder block subassemblies are positioned such that the pistons of one subassembly extend toward the other subassembly. A common yoke plate is mounted between the two cylinder blocks and bears the two groups of piston shoes, one on each of its two bearing surfaces. Each cylinder block is driven independent of and in direction opposite to the other by an electric motor integrally mounted such that its hollow rotor houses the block and drives it. All components described above are contained in one housing and operate submerged in hydraulic fluid.

DESCRIPTION

Figure 1:
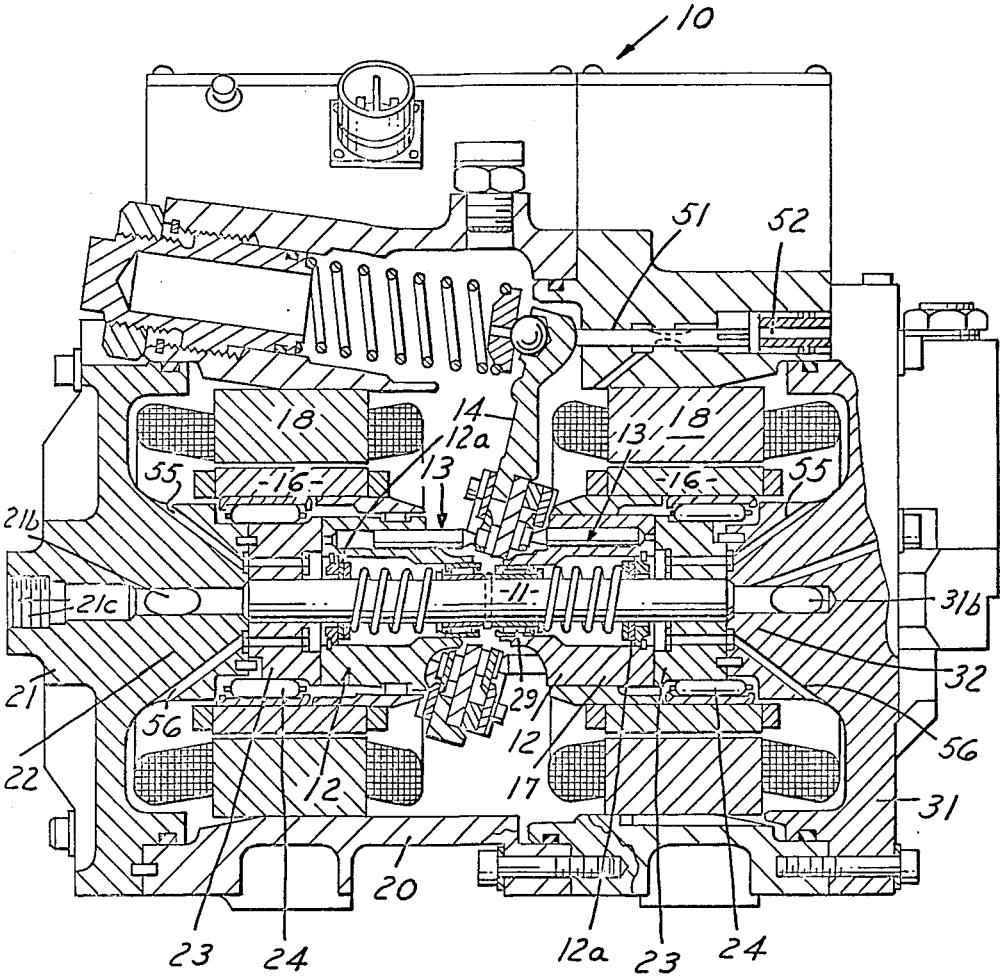
FIG. 1 is a longitudinal part-sectional view of an electric motor driven hydraulic pump embodying the invention and is implicitly referred to unless otherwise noted.
Figure 2:
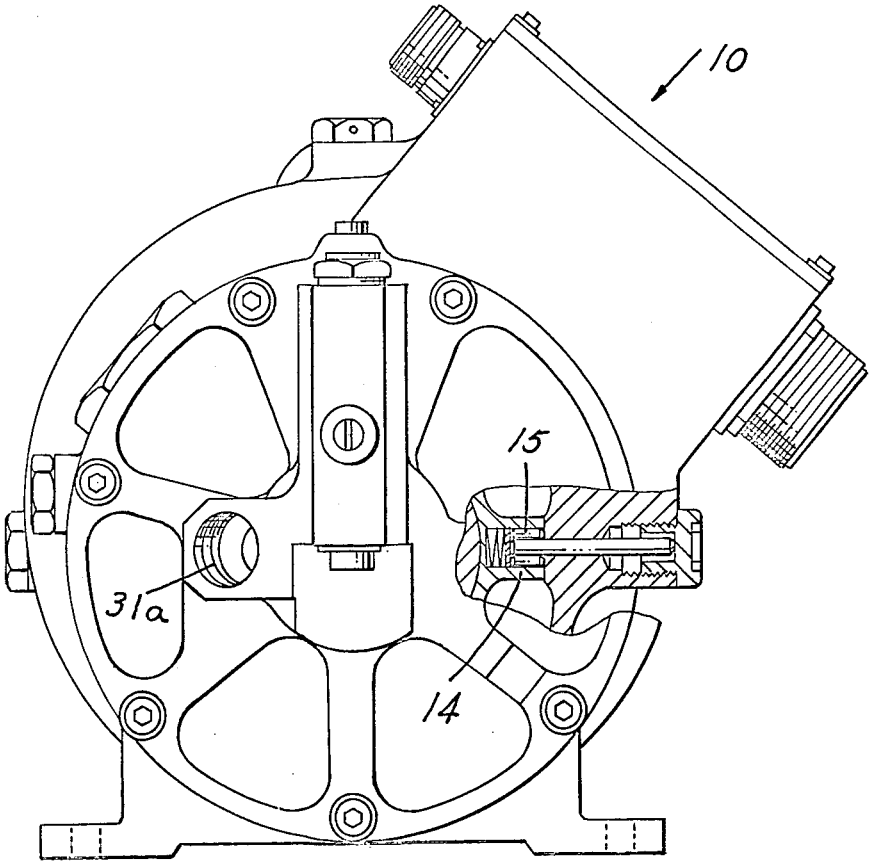
FIG. 2 is a part-sectional end view of the same.

Referring to FIG. 1, basically the invention comprises a housing 10 in which a stationary shaft 11 of constant diameter is mounted. The said shaft supports two substantially identical cylinder block and piston subassemblies 12 which have their piston and shoe subassemblies 13 associated with a common yoke plate 14 that is pivoted on pintle bearings 15 (FIG. 2). An electric motor rotor 16 is fixed on each cylinder block 17 and is associated with a stator 18 that is mounted in the housing 10 to thereby form two electric motor and pump halves which can be rotated independently of one another.

Figure 3:
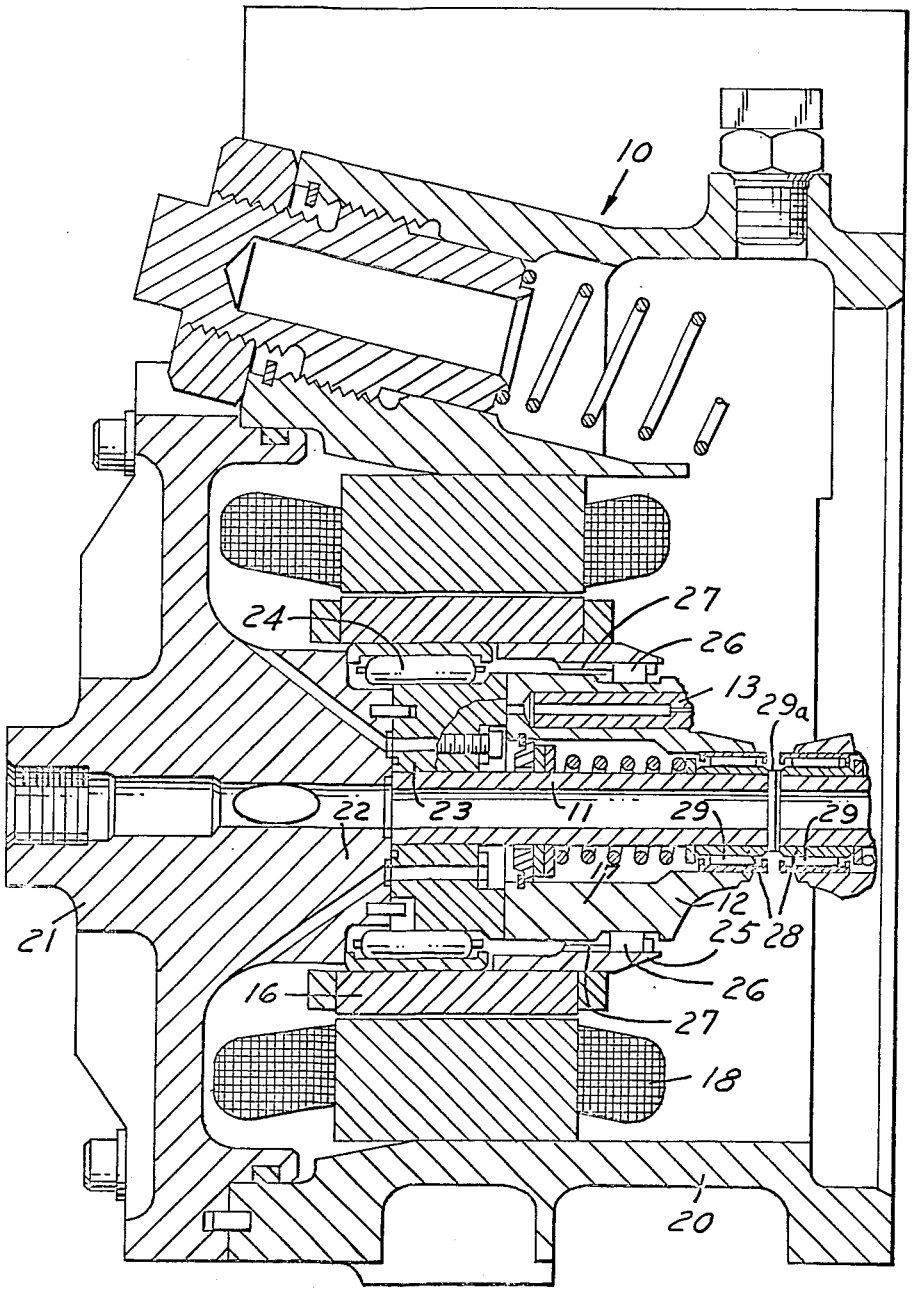
FIG. 3 is a fragmentary sectional view on an enlarged scale of a part of the electric motor driven pump shown in FIG. 1.
Figure 5:
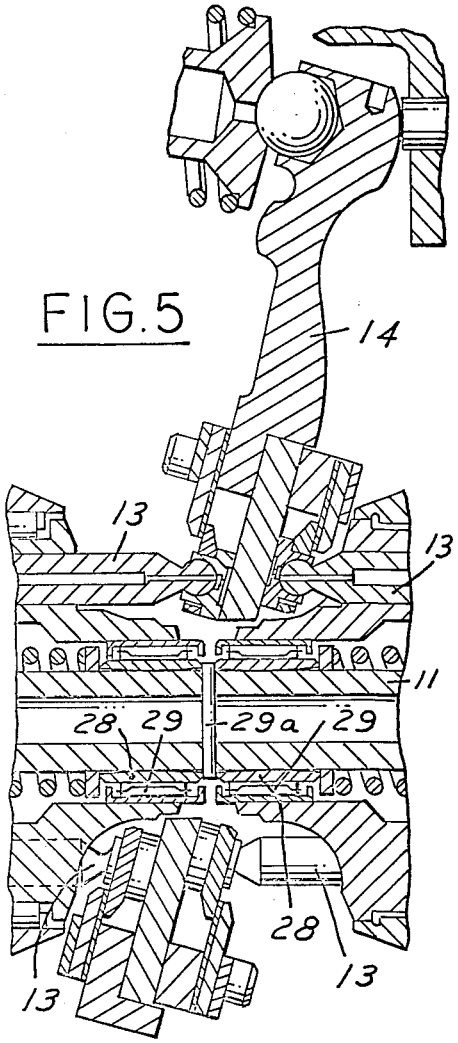
FIG. 5 is a fragmentary sectional view on an enlarged scale of another portion of the electric motor driven pump shown in FIG. 1.
Figure 7:
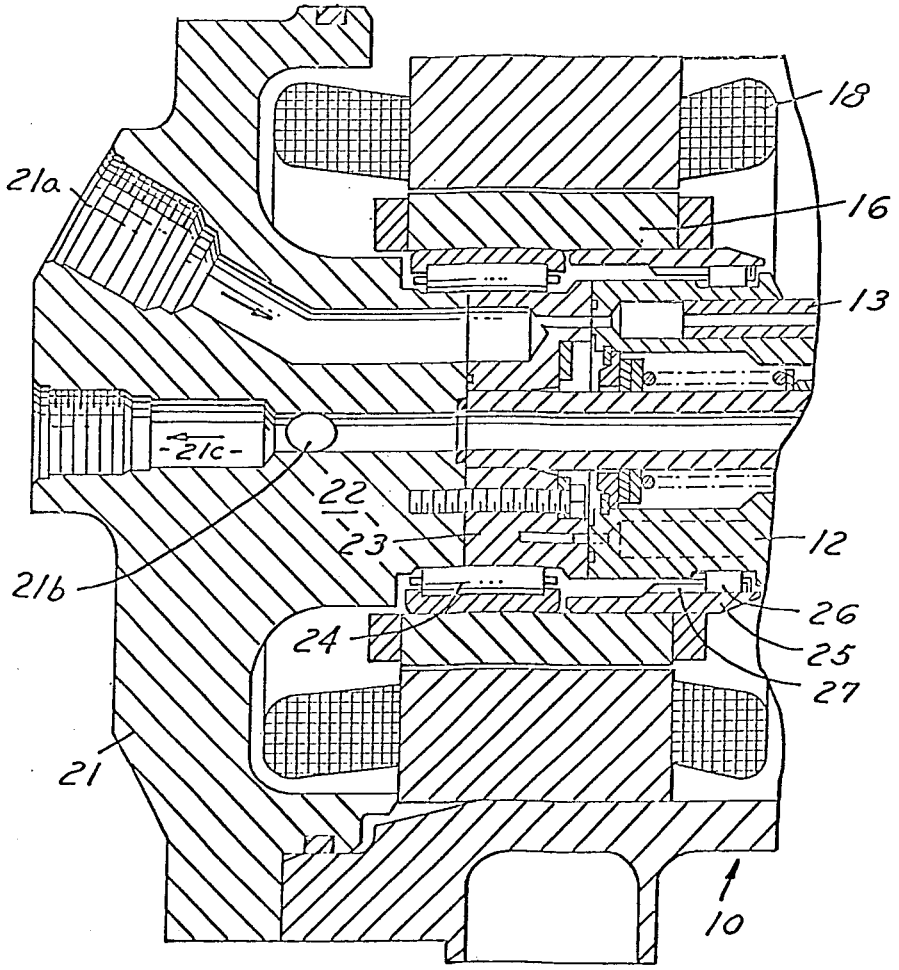
FIG. 7 is a fragmentary sectional view of a further part of the electric motor driven pump shown in FIG. 1.

Referring to FIG. 3, the first portion of the housing 10 comprises a cylindrical member 20 to which is mounted the electric motor stator 18 and an end member 21 of which the central part 22 is suitably shaped to function as a valve block. A valve plate 23 containing appropriate kidney slots for flow commutation with the cylinder block 17 and axial opening for flow communication with the valve block 22 is bolted to the end member 21. The valve plate 23 also supports and forms a suitable rolling surface for the roller bearing 24 which is firmly held by the electric motor rotor 16. The rotor 16 has, fixed to it, a sleeve 25 by a press fit. Sleeve 25 is coupled to the cylinder block 17 by means of the keys 26 and the keyways 27 to transmit the motor torque (also FIG. 7). This arrangement provides a drive without inhibiting relative radial movement between the cylinder block 17 and the sleeve 25 permitting the cylinder block 17 to maintain sealing contact with valve plate 23. One end of the shaft 11 is contained and supported by the valve plate 23 and the other end is held similarly by an identical valve plate in the second portion of the housing 10 as described below. The shaft 11 supports the raceway 28 that forms a suitable rolling surface for the bearing 29 which is press fitted in the cylinder block 17. The inside diameter of the raceway 28 (FIG. 5) is designed with a crown in the middle so as to permit a slight swivel of the cylinder block and piston subassembly 12 as necessary due to minor misalignment. The bearing 29, together with the thrust bearing surface created at the junction of the cylinder block 17 and the valve plate 23, defines the axis of rotation of the cylinder block 17. Independently, the bearings 24 and 29 define the axis of rotation of the electric motor rotor. A positive displacement axial piston pump of such description operates in a manner well known in the prior art and as shown, for example, in U.S. Pat. No. 3,481,277, which is incorporated herein by reference.

As the cylinder block is rotated, the pistons are caused to reciprocate within the cylinder block bores or chambers. The shoes on the ends of the pistons are held against a bearing surface by compression force during the discharge stroke and by a shoe hold-down plate with its retainer ring during the intake stroke. The bearing surface is defined by the yoke and is held at an angle to the axis of rotation. During the intake stroke, each piston shoe follows the shoe bearing plate away from the valve plate, the piston is withdrawn from the cylinder block and the fluid is drawn into its cylinder block bore through the valve plate inlet port. Further rotation of the cylinder block brings it to the discharge stroke during which the piston shoe follows the shoe bearing plate toward the valve plate expelling the fluid from the piston bore through the outlet portion of the valve plate.

Figure 4:
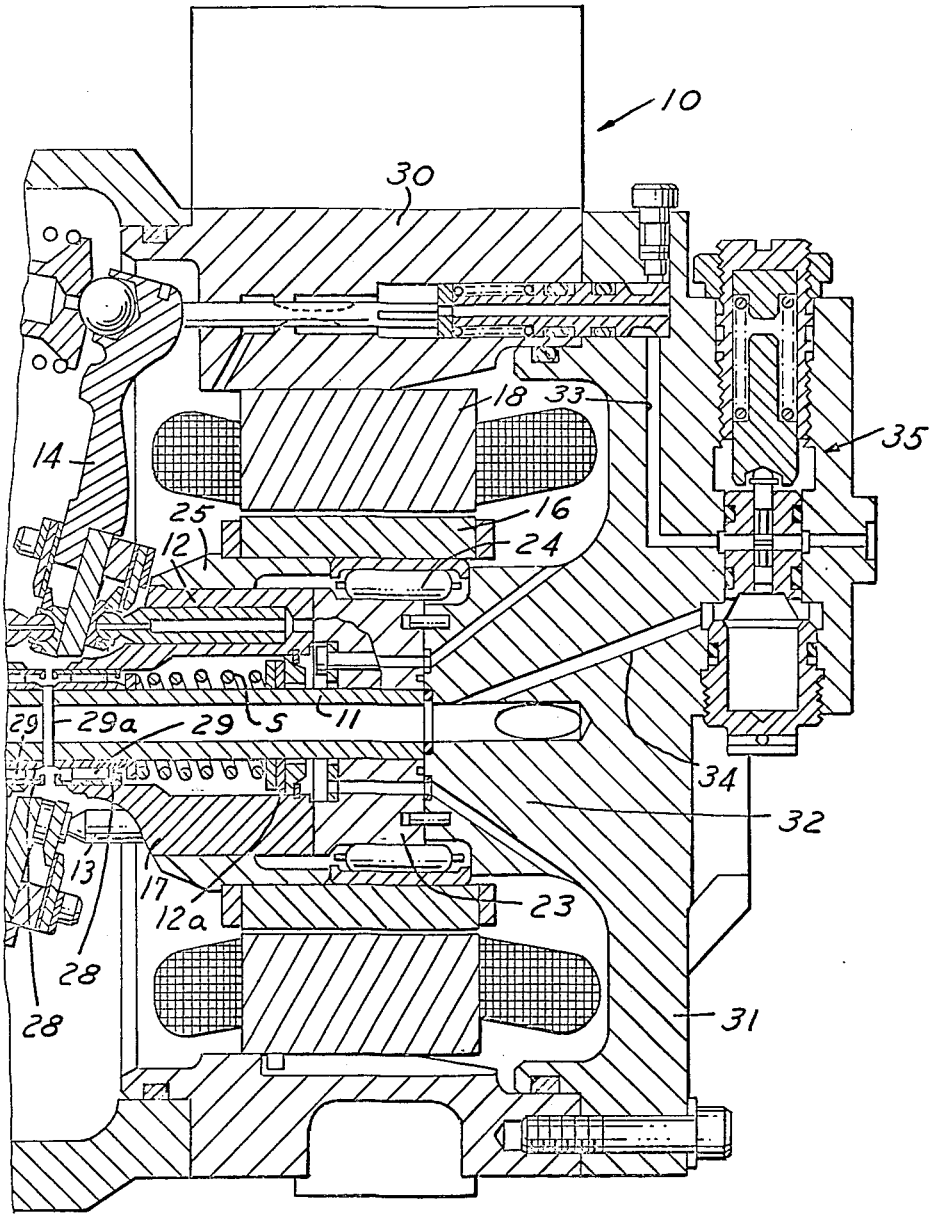
FIG. 4 is a fragmentary sectional view on an enlarged scale of another part of the electric motor driven pump shown in FIG. 1.

Referring to FIG. 4, the second portion of the housing 10 includes a cylindrical portion 30 and an end member 31 of which the central part 32 is suitably shaped to function as a valve block. The electric motor stator 18, the rotor 16, the cylinder block 17, the valve plate 23, the bearing 24, the sleeve 25, the keys 26 (FIG. 3), the keyways 27 (FIG. 3), the raceway 28, the shaft 11 and the bearing 29 function and are assembled in a manner identical to those of the same items in FIG. 3. The items not identified and those not shown are referred to in FIG. 3. Bearing raceways 28 abut a pin **29*a* (also FIG. 5) and a spring S is interposed between a washer abutting the respective raceway 28 and a washer abutting a thrust bearing 12*a* to maintain an intimate contact between the respective cylinder block and is valve plate 23**.

The end member 31 includes the passageways 33 and 34 that connect a pressure compensator valve assembly 35 of the well known type to the control pressure chamber and the high pressure port respectively. The compensator 35 controls the flow to a piston acting upon the yoke plate in a manner well known as shown, for example, in U.S. Pat. No. 2,502,546, which is incorporated herein by reference. Such pressure compensator valve functions in response to pressure, maintaining an essentially constant value of pressure that corresponds to the pressure setting of the valve.

Each cylinder block and piston assembly 12 functions in a conventional manner with the common yoke plate 14.

Figure 6:
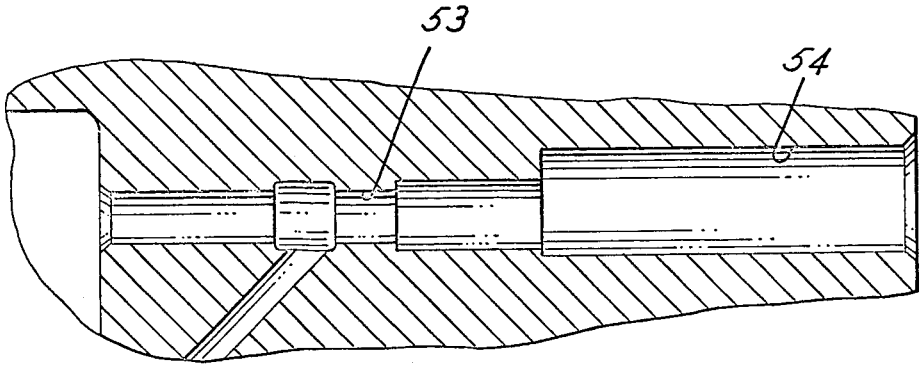
FIG. 6 is a fragmentary sectional view of another part of the electric motor driven pump shown in FIG. 1, parts being broken away.

Referring to FIG. 6, the cylindrical member 30 (FIG. 4) includes a bore 53 for a yoke actuating piston 51 (FIG. 1) and a chamber 54 for a transfer tube 52 (FIG. 1). The transfer tube also provides a positive stop for the actuating piston defining the full stroke position of the yoke.

In operation, the electric motors are energized so that they rotate in opposite directions driving the corresponding cylinder block-piston subassemblies 12, the outlet flows from which are combined to produce a single output flow.

Fluid is drawn through inlets **21*a* (FIG. 7), 31*a* (FIG. 2) in the end members 21, 31 respectively and is directed to the arcuate (kidney shaped) inlets of the valve plate 23. The fluid passes through the two pumping mechanisms, develops higher pressure and is directed through the passages 21*b*, 31*b* to finally join in the bore of the hollow shaft 11. Thereafter, the fluid flows through a single outlet 21*c* in the member 21**. Alternately, the pressurized fluid from the two halves could be joined with passages external of the housing.

A part of the fluid leaking at the two interfaces of the valve plates 23 with the mating valve blocks 22, 32 on one side and the cylinder blocks 17 on the other, passes through passages 55, 56, through the axial slots at the stator outside diameter end through the air gap between the rotor and stator, thereby, cooling the electric motors; the other part of the leakage flowing in such a manner so as to lubricate and cool the bearings 24, **12*a* and 29**.

In accordance with the invention, it is possible to synchronize one rotor with respect to the other electrically to set the high pressure pulse-train of one outlet portion 180° out of phase with that of the other outlet port, thereby lowering the associated audible noise significantly and doubling the noise frequency at the same time.

Figure 12:
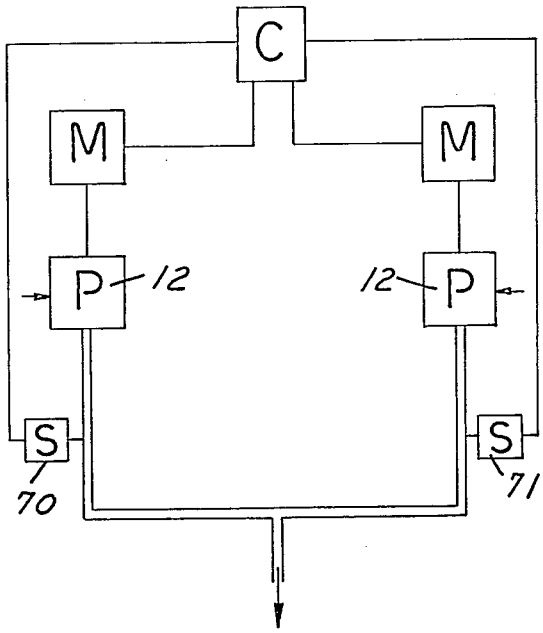
FIG. 12 is a schematic diagram of a control system which can be used with the electric motor driven pump.

Referring to FIG. 12, a typical control system for noise reduction comprises sensors 70, 71 which sense the pulsations of the outlet pressure from the respective pumping mechanisms 12 that are driven by the associated electric motors M and direct the signals to a controller C that functions to synchronize the positions and the speeds of the two motor-rotors to achieve a 180° phase-difference between the two sets of pressure-pulsations.

As a result of the construction, the package defining the electric motor driven hydraulic pump is axially compact, easier and less costly to make and has relatively quiet operation in comparison with the present-technology designs.

As a consequence of the opposite rotations of the two subassemblies 12, the high pressure ports are on the same side of the axis of rotation, thus cancelling the axial components of the forces on the yoke. The radial components of the forces are also equal and opposite but produce a destroking couple on the yoke which is proportional to the high pressure and the stroke angle—a relationship that inherently generates desirable constant power region of operation when combined with the stroking yoke moments resulting from the yoke spring and from the linear motion of the pistons.

At full stroke and full speed the stroking yoke moment created by the linear motion of the pistons is quite significant since it is proportional to the stroke angle and to the speed squared. At starting, therefore, if the pressure rises faster than the motor speed, a typical low temperature condition, the destroking yoke moment will be large enough to quickly destroke the pump thereby significantly reducing the load torque on the electric motors. It is possible now to design the motors with low starting currents, a very desirable outcome, without creating a starting problem and without sacrificing performance at full load.

Normal leakages at the interfaces of the cylinder block and the valve plates cause a positive cooling flow across the electric motor stator towards the center. Such an intimate fluid contact with the stator windings and the rotor bars permit a superior heat dissipation of the electric motor so that lighter and smaller motors can be used that are also capable of high overloads of short duration.

Figure 8:
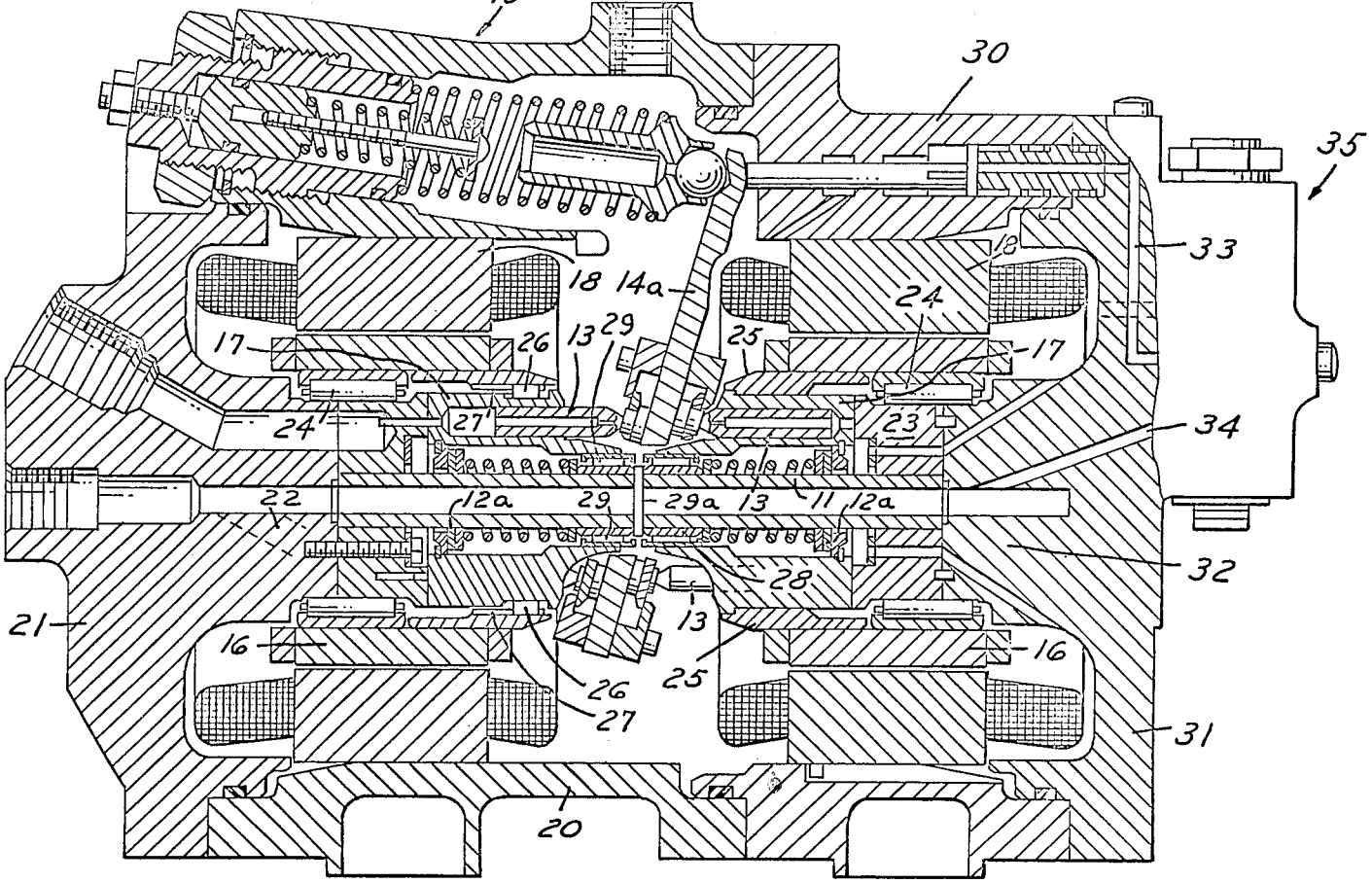
FIG. 8 is a longitudinal sectional view of a modified form of electric motor driven pump.
Figure 9:
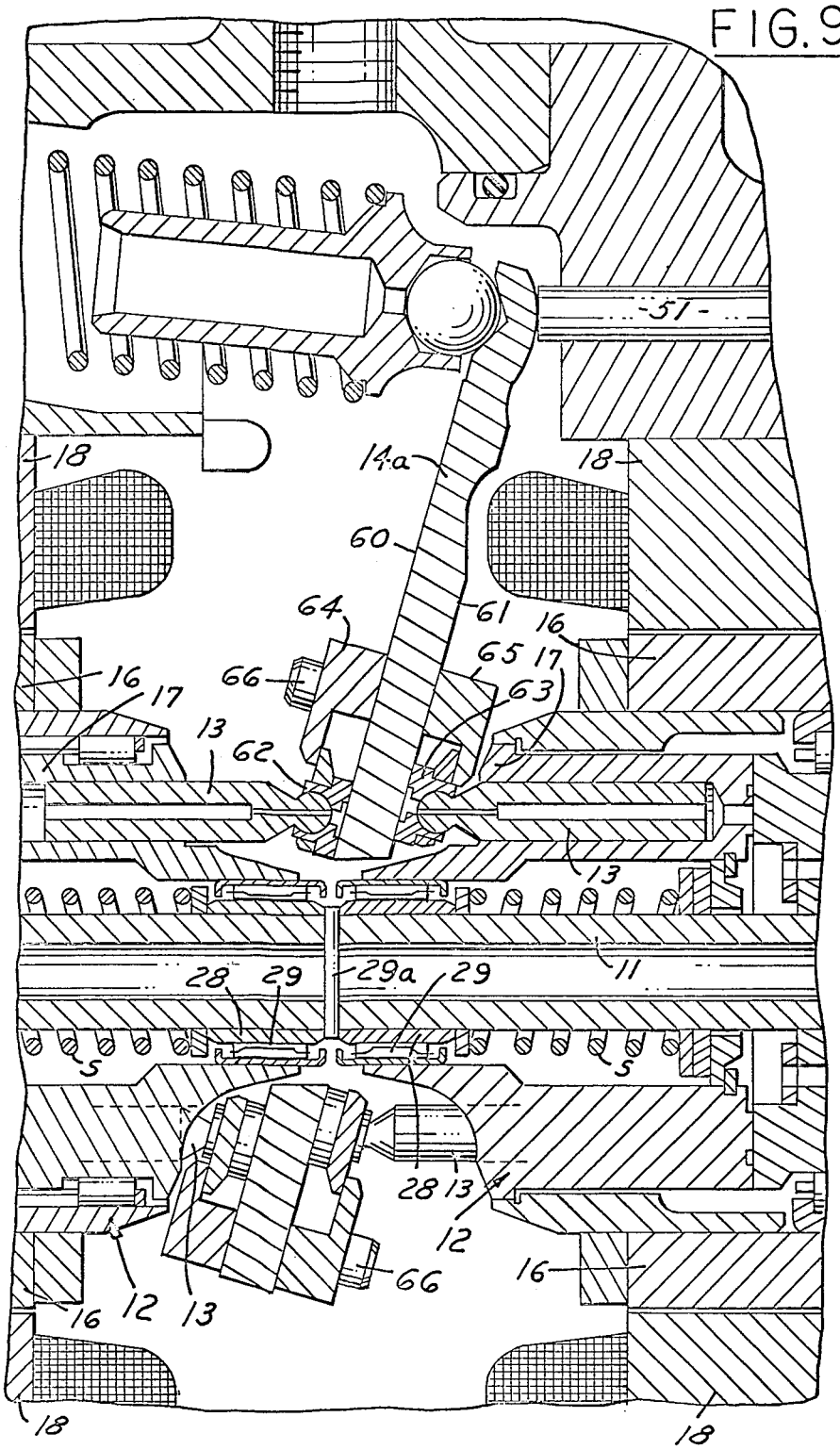
FIG. 9 is a fragmentary sectional view on an enlarged scale of a part of the electric motor driven pump shown in FIG. 8.
Figure 10:
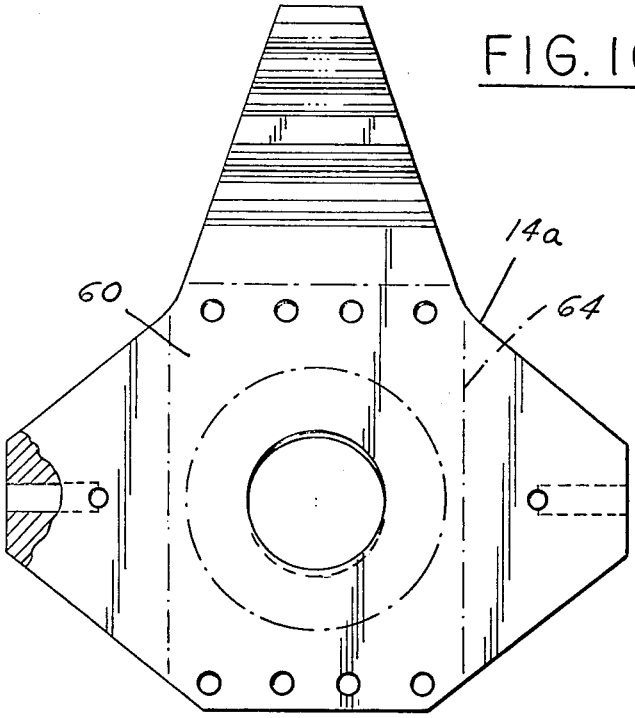
FIG. 10 is a plan view of the yoke plate utilized in the electric motor driven pump shown in FIGS. 8 and 9.

In the modified form of the apparatus as shown in FIGS. 8–10, the yoke plate 14a is modified to provide a simpler construction requiring a fewer number of parts. In all other respects the apparatus is the same as previously described.

Referring to FIG. 9, the yoke is a single plate, 14a, of uniform thickness except, in the area near the seats for the ball and the piston 51, it is slightly thinner so that such an area can be cleared during the process of lapping its two sides 60, 61 which serve as the bearing surfaces for the shoes 62, 63 of the pumping mechanisms 12. The shoes are held down with the two rectangular recessed plates 64, 65 fastened by screws 66. The pintle bearings, not shown, are installed in the housing 10 and the associated pins, also not shown, in the yoke plate 14a—reverse of the assembly shown in FIG. 2.

Figure 11:
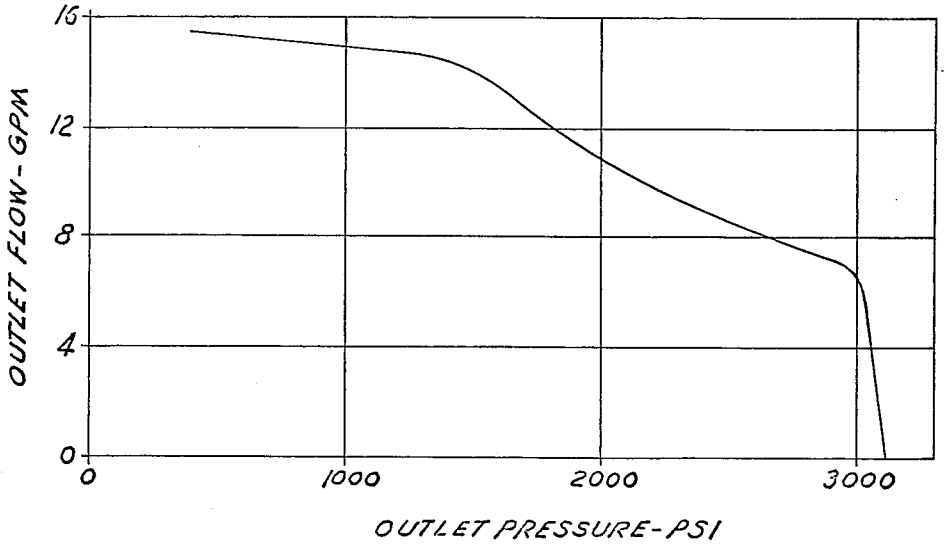
FIG. 11 is a curve of flow versus pressure of an electric motor driven pump embodying the invention.

Referring to FIG. 11, a stead-state performance curve, based upon an actual test of the unmodified version of the apparatus described here, is plotted to verify a portion of its theoritical behavior. Particularly, the curve demonstrates the inherent constant power region of its operation and the flat cut-off compensator-behavior past the half of its rated-full-flow point.

The invention is not limited to its applicability to conversion of electrical power to hydraulic power only. Those familiar with the art will note that the package can be readily configured to convert hydraulic power into electric power as well—the pumping mechanisms 12 operating as hydraulic motors driving the electric motors as generators—using the fundamental concepts disclosed in this invention.

What is claimed is:

1. An electric motor driven inline hydraulic apparatus comprising a housing common to the electric motor and the hydraulic pump, a stationary shaft mounted in said housing, spaced cylinder block subassemblies that rotate around and are mounted on said shaft, each such subassembly including a cylinder block and a plurality of circumferentially spaced pistons, said cylinder block subassemblies being positioned such that the pistons of subassembly extend toward the other subassembly, a common yoke plate mounted in association with said pistons and between said cylinder block subassemblies, a hollow electric motor rotor individual to each cylinder block subassembly arranged to house and drive said cylinder block subassembly and an associated electric motor stator individual to each rotor mounted in said housing, each said stator, its associated rotor and its associated cylinder block subassembly being operable independently of and in direction opposite to the other.

2. The apparatus set forth in claim 1 wherein said shaft is stationary and bearings are provided for supporting the cylinder block-piston subassembly and rotor.

3. The apparatus set forth in claim 1 wherein said shaft is hollow, said housing including means for delivering the fluid from said cylinder block subassembly to a common outlet through said hollow shaft.

4. The apparatus set forth in claim 1 wherein said apparatus is operated by energizing said electric motor to drive the hydraulic pump.

5. The apparatus set forth in claim 4 including control means responsive to the pulsations of fluid pressure from said cylinder block assemblies for controlling and synchronizing the operation of the electric motors to produce a 180° phasing of the said pulsations thereby resulting in a more uniform less pulsating flow from the apparatus.

6. The apparatus set forth in claim 1 wherein said common yoke plate comprises a single plate having machined surfaces, said pistons having shoes associated with the free ends thereof directly engaging said shoes and a hold-down plate associated with the shoes of each cylinder block subassembly for maintaining engagement between said shoes and the respective surface of the yoke plate.

7. The apparatus set forth in claim 1 including a single yoke spring assembly associated with one side of said yoke plate and an actuator piston associated with the other side of said yoke plate, a compensator valve responsive to the outlet pressure of said pump and controlling the position of said yoke actuating piston, and including said shaft that is hollow for connecting the two high pressure ports together internally, thereby maintaining equal and opposite yoke forces.

8. The apparatus set forth in claim 1 including means for supplying hydraulic fluid to said hydraulic pump to drive said pump as a hydraulic motor and drive said electric motor as a generator.

* * * * *